US010398279B2

(12) United States Patent
Birdsell

(10) Patent No.: US 10,398,279 B2
(45) Date of Patent: Sep. 3, 2019

(54) DISPENSING ENCLOSURE FOR A CONTAINER

(71) Applicant: SharkNinja Operating LLC, Newton, MA (US)

(72) Inventor: Walter Birdsell, Marlborough, MA (US)

(73) Assignee: SharkNinja Operating LLC, Needham, MA (US)

( * ) Notice: Subject to any disclaimer, the term of this patent is extended or adjusted under 35 U.S.C. 154(b) by 42 days.

(21) Appl. No.: 15/356,349

(22) Filed: Nov. 18, 2016

(65) Prior Publication Data

US 2017/0144810 A1 May 25, 2017

Related U.S. Application Data

(60) Provisional application No. 62/257,547, filed on Nov. 19, 2015.

(51) Int. Cl.

| | |
|---|---|
| ***B65D 47/24*** | (2006.01) |
| ***A47L 13/22*** | (2006.01) |
| ***B65D 47/32*** | (2006.01) |

(52) U.S. Cl.

CPC ..... *A47L 13/225* (2013.01); *B65D 47/248* (2013.01); *B65D 47/32* (2013.01)

(58) Field of Classification Search

CPC ..... A47L 13/225; B65D 47/248; B65D 47/32; F16K 15/063

USPC ..... 222/511, 549, 546, 559, 563, 501, 518

See application file for complete search history.

(56) References Cited

U.S. PATENT DOCUMENTS

| | | | | |
|---|---|---|---|---|
| 2,376,404 A * | 5/1945 | Thoms | B65D 47/248 169/74 |
| 3,190,508 A * | 6/1965 | Petersen | B65D 83/54 222/402.2 |
| 4,102,476 A | 7/1978 | Loeffler | |
| 4,281,779 A * | 8/1981 | Shepard | B65D 47/42 222/501 |
| 4,378,077 A * | 3/1983 | Akino | B65D 47/244 222/182 |
| 4,522,318 A * | 6/1985 | Del Bon | B65D 83/48 222/402.24 |

(Continued)

FOREIGN PATENT DOCUMENTS

WO 2014085444 A1 6/2014

*Primary Examiner* — Donnell A Long

(74) *Attorney, Agent, or Firm* — Grossman Tucker Perreault & Pfleger, PLLC

(57) ABSTRACT

Dispensing enclosure system for a container includes a body having an exterior surface and an interior surface, where the interior surface is configured to be coupled to the container. The system includes a valve on the exterior surface of the body, where the valve is capable of allowing fluid to exit from the container. The system also includes a seal disposed within the interior surface of the body, the seal having an inner circumference and an outer circumference such that in a relaxed configuration each of the inner circumference and the outer circumference is located on a separate plane, and in an engaged configuration a first portion of the inner circumference and the outer circumference are located substantially on the same plane, and a second portion of the inner circumference forms a curvature, where the second portion is between the first portion and the outer circumference.

20 Claims, 10 Drawing Sheets

(56) References Cited

U.S. PATENT DOCUMENTS

| | | | | |
|---|---|---|---|---|
| 4,648,519 | A | 3/1987 | Kennedy | |
| 5,165,578 | A | 11/1992 | Laible | |
| 5,875,941 | A * | 3/1999 | Hsu | A47J 41/00 220/715 |
| 5,988,457 | A * | 11/1999 | Andrew | A47G 19/12 222/475.1 |
| 6,167,586 | B1 * | 1/2001 | Reed, Jr. | A47L 5/28 137/614.2 |
| 6,874,656 | B2 | 4/2005 | Rohr et al. | |
| 6,951,295 | B1 | 10/2005 | Gaus et al. | |
| 7,350,666 | B2 * | 4/2008 | Essebaggers | A47G 19/2272 220/714 |
| 8,038,035 | B2 * | 10/2011 | Forbis | B65D 47/249 222/153.14 |
| 8,286,840 | B2 * | 10/2012 | Jacuk | B65D 83/54 222/402.1 |
| 2005/0230414 | A1 * | 10/2005 | Yoshida | B67D 3/0003 222/1 |
| 2007/0039980 | A1 * | 2/2007 | Kjeldsen | B65D 47/248 222/514 |
| 2017/0065138 | A1 * | 3/2017 | DeJonge | A47L 11/4083 |

* cited by examiner

DISPENSING ENCLOSURE FOR A CONTAINER

CROSS REFERENCE TO RELATED PATENT APPLICATIONS

This application claims the benefit of U.S. Provisional Application No. 62/257,547 entitled "Dispensing Enclosure for a Container" filed Nov. 19, 2015, herein incorporated by reference.

TECHNICAL FIELD

This disclosure relates to an enclosure system for dispensing fluid from a container.

BACKGROUND

Containers for dispensing fluid are known in the art. In general, containers that dispense liquid include a return air valve to allow return air to enter the container, otherwise a partial vacuum could build up within the container when fluid is dispensed. If a partial vacuum builds up within a container without a return valve, then return air will try to enter the dispensing valve when fluid is dispensed such that fluid will not be dispensed evenly from the container. If the partial vacuum is great enough, fluid may not be able to be dispensed from the container at all.

One example of a bottle having a return air valve is used with a steam mop, an embodiment of which is disclosed in International Application No. PCT/US2013/071988 ('988 application), filed Nov. 26, 2013 and published Jun. 5, 2014, which is incorporated by reference herein in its entirety. The bottle enclosure for this steam mop includes a piston valve to dispense fluid and a duck bill valve to allow the passage of return air. However, this bottle enclosure includes a number of parts which can increase its complexity and cost of production.

SUMMARY

Disclosed are enclosure systems for dispensing fluid from a container. In one embodiment, a seal for an enclosure system includes a ring having an inner circumference and an outer circumference. In a relaxed configuration, each of the inner circumference and the outer circumference is located on a separate plane. In an engaged configuration, a first portion of the inner circumference and the outer circumference are located substantially on the same plane and a second portion of the inner circumference forms a curvature, the second portion between the first portion and the outer circumference.

In one embodiment, the ring of the seal is formed of an impermeable material. In another embodiment, the curvature of the seal is flexible and capable of allowing air to pass thereby. In yet another embodiment, the outer circumference of the seal further includes an inner wall and an outer wall forming a channel therebetween. In operation, the channel is configured to engage a rim of a container in the engaged configuration.

In one embodiment, an enclosure system for a container includes a body having an exterior surface and an interior surface, the interior surface configured to be coupled to the container. The enclosure system includes a valve on the exterior surface of the body, the valve operable to allow fluid to exit from the container, and a seal disposed within the interior surface of the body, the seal having an inner circumference and an outer circumference.

In a relaxed configuration, each of the inner circumference and the outer circumference is located on a separate plane. In an engaged configuration, a first portion of the inner circumference and the outer circumference are located substantially on the same plane, and a second portion of the inner circumference forms a curvature, the second portion between the first portion and the outer circumference.

In one embodiment, the seal of the enclosure system or cap is formed of an impermeable material. In another embodiment, the enclosure system or cap further includes an aperture on the exterior surface of the body, the aperture capable of allowing air to pass into a cavity defined by the curvature. In yet another embodiment, the outer circumference of the seal further includes an inner wall and an outer wall forming a channel therebetween. In the relaxed configuration, the channel is spaced from the interior surface of the body and wherein in the engaged configuration the channel abuts the interior surface of the body. Furthermore, in the engaged configuration the channel is configured to receive the rim of the container.

In one embodiment, the valve of the enclosure system or cap further includes an orifice through the center of the valve, and a plunger configured to movably fit within the orifice. In operation, the plunger is capable of moving between a closed position in which the plunger prevents fluid from passing through the orifice, and an open position in which the plunger allows the passage of fluid through the orifice. The valve further includes a bias element urging the plunger to the closed position.

In another embodiment, the valve of the enclosure or cap further includes a retainer for guiding the plunger through the valve, the retainer includes fingers for retaining the plunger in the closed position. In some embodiments, the body of the cap is substantially cylindrical and the interior surface includes threads for coupling to the rim of the container. In other embodiments, the body of the cap includes ratcheting and the container includes detents, such that the ratcheting and the detents are configured to mate with each other to fixedly attach the cap to the container. In the alternative, the detents can be on the body of the cap and the ratcheting can be on the container.

In one embodiment, a method of controlling a flow rate through a container enclosure system includes providing a cap for the container, the cap having a body having an exterior surface and an interior surface, where the interior surface of the body is configured to be coupled to the container. Providing a valve on the exterior surface of the body where the valve is operable to allow fluid to exit from the container. In one embodiment, the valve includes an orifice through the center of the valve, a plunger configured to movably fit within the orifice, the plunger capable of moving between a closed position in which the plunger prevents fluid from passing through the orifice and an open position in which the plunger allows the passage of fluid through the orifice. In another embodiment, the valve includes a bias element to urge the plunger to the closed position.

In some embodiments, the enclosure system includes a seal disposed within the interior surface of the body, the seal having an inner circumference and an outer circumference, such that in a relaxed configuration each of the inner circumference and the outer circumference is located on a separate plane, and in an engaged configuration a first portion of the inner circumference and the outer circumference are located substantially on the same plane, and a second portion of the inner circumference forms a curvature, the second portion between the first portion and the outer circumference. In operation, fluid may be dispensed from the container by actuating the plunger.

In another embodiment, the method of controlling a flow rate through a container enclosure includes adjusting the flow of fluid from the container by adjusting the thickness of the inner circumference of the seal. In some instances, the adjusting step further includes forming one or more apertures on the seal, where the seal is formed of an impermeable material.

In another embodiment, the method of controlling a flow rate through a container enclosure includes adjusting the flow of fluid from the container by forming one or more apertures on the exterior surface of the body, the one or more apertures operable to allow air to pass into a cavity defined by the curvature. In some instances, the adjusting step further includes adjusting the size of the one or more apertures on the exterior surface of the body.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

Figure 1:
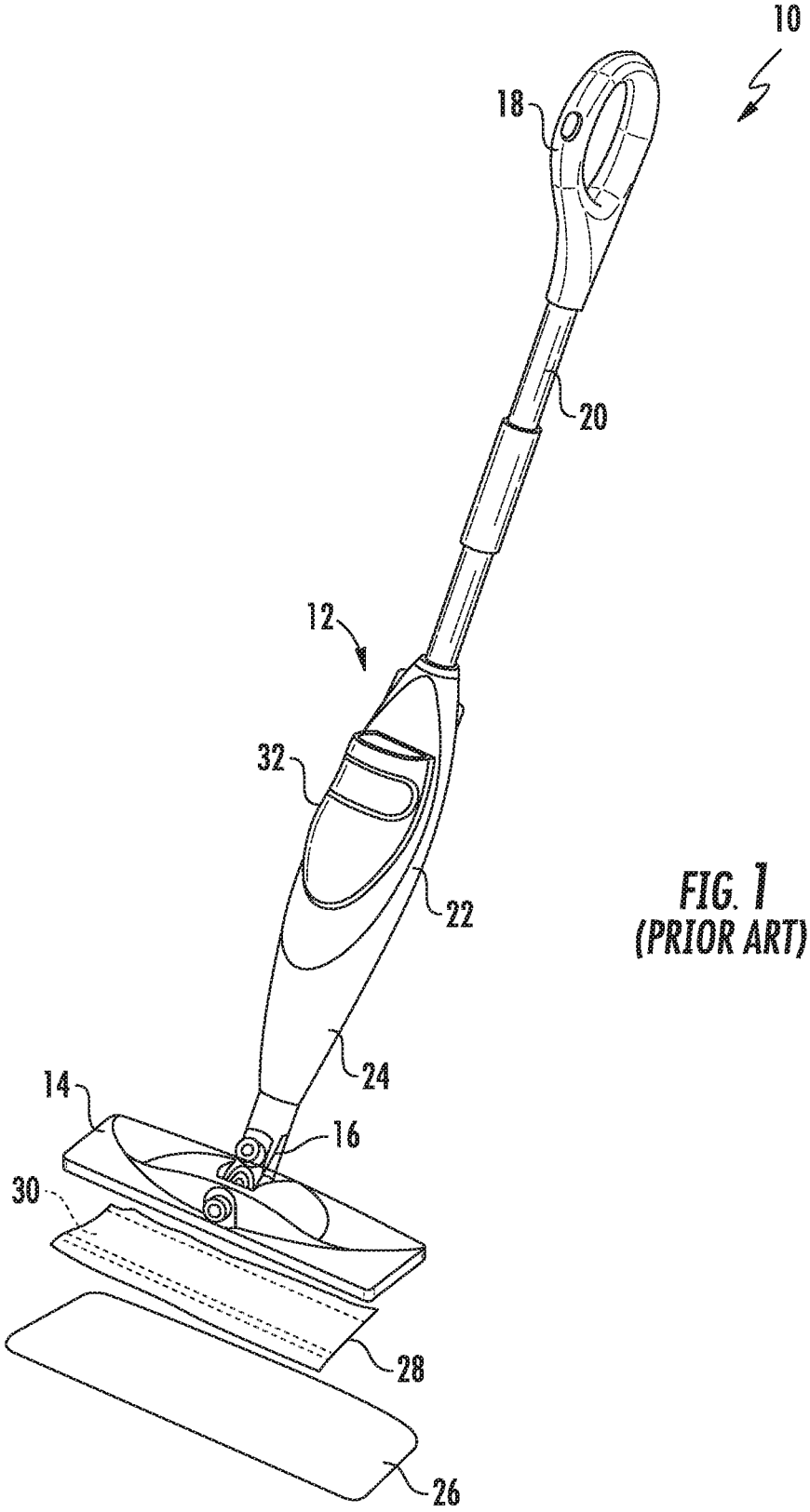
FIG. 1 (PRIOR ART)
FIG. 1 shows a steam cleaning appliance known in the prior art.

FIG. 1 shows a steam cleaning appliance 10 as disclosed in the '988 application, which is incorporated by reference herein in its entirety. As shown, the appliance 10 includes an elongated appliance body 12 attached to a cleaning head 14, such as a mop head, by a universal connector joint 16. In one embodiment, the appliance body 12 includes a handle 18, a pole 20, and a housing 22. Within the housing 22 is a steam generating unit 24, which can generate and deliver steam to a steam-permeable pad 26 that may be removably attachable to the cleaning head 14. In some embodiments, the pad 26 may be a cleaning sheet 28 that may be removably attached to the cleaning head 14. The cleaning sheet 28 may be attached to the cleaning head by an attachment layer 30.

In some embodiments, the front side of the housing 22 may include a slot for housing a liquid reservoir or container 32 which can hold a liquid, such as a cleaning solution. The cleaning solution may be soap, sanitizing agent, disinfectant, encapsulant, or a combination thereof. The cleaning solution may also include a scent. In other embodiments, the liquid reservoir 32 may simply hold water. The liquid container 32 may be removable in some instances, and non-removable in other instances. In some embodiments, the liquid container 32 may be filled using a fill cup to pour into an opening. The liquid container 32 may include a cap or an enclosure for dispensing the fluid through the appliance body 12 such that the fluid can be sprayed or distributed on the floor or any cleaning surface in combination with the pad 26 or cleaning sheet 28.

Figure 2A:
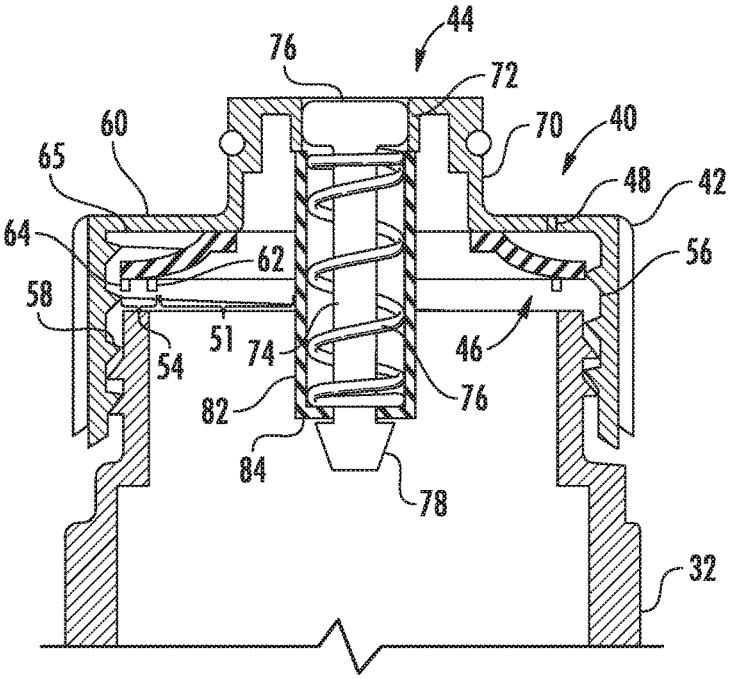
FIGS. 2A-2B show a dispensing enclosure or a cap for a container according to one embodiment of the present disclosure.
Figure 2B:
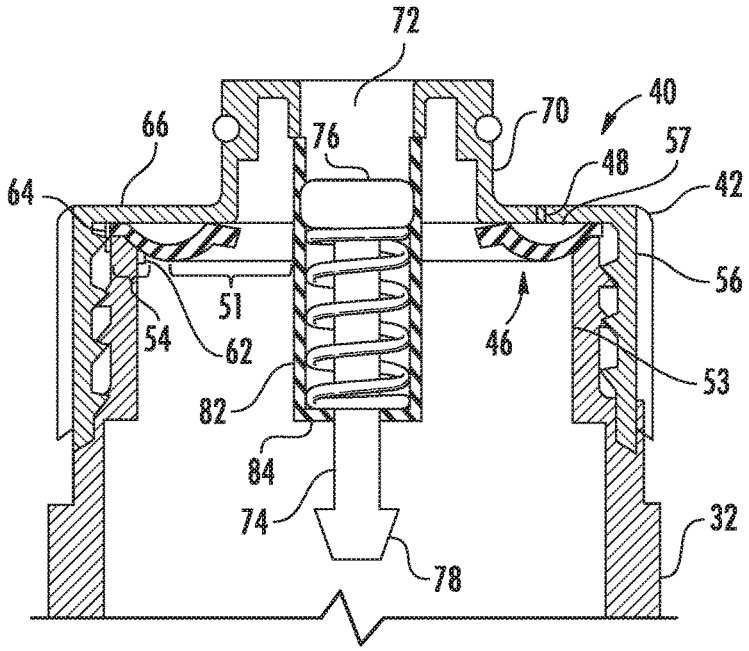

FIGS. 2A-2B show a dispensing enclosure or a cap 40 for a liquid container 32 according to one embodiment of the present disclosure. The cap 40 includes a body 42 having an exterior surface and an interior surface, the interior surface configured to be coupled to the liquid container 32. The cap 40 includes a valve 44 and a seal 46. In one embodiment, the valve 44 may be disposed about the exterior surface of the body 42, and may be a dispensing valve or a piston-type valve capable of allowing fluid to exit from the container 32 through the cap 40. In another embodiment, the seal 46 may be disposed within the interior surface of the body 42, and may be an air return valve.

In some examples, the seal 46 may be formed of an impermeable material such as rubber or polytetrafluoroethylene (PTFE). In other examples, the seal 46 may be formed of other suitable polymeric material. The seal 46 may allow the passage of return air or other gases through the cap 40 through at least one hole or aperture 48 after fluid has been dispensed and a partial vacuum exists within the container 32. In some instances, the impermeable material is capable of allowing air or other gases to pass through it, but not water or other liquid. As such, doing so may minimize leaking through the seal 46.

In one example, the seal or air return valve 46 includes the least one hole 48 and an annular resilient member 50 mounted to the interior surface of the cap 40 (best illustrated in FIGS. 4A-4E). The annular member 50, which may include a bladder valve, includes a channel 52 located adjacent its outer circumference 54 and is configured to receive a rim 56 of the container 32. The annular resilient member 50 creates an enclosure around the at least one hole 48 when the cap 40 is mounted to the container 32 and allows the passage of return air.

In another example, the seal or air return valve 46, disposed within the interior surface of the body 42, may have an inner circumference 51 and an outer circumference 54. In a relaxed configuration, e.g., when the cap 40 is not secured to the container 32, each of the inner circumference 51 and the outer circumference 54 are on a separate plane. In other words, the inner circumference 51 and the outer circumference 54 are not linear. This is best illustrated in FIG. 2A, where the inner circumference 51 and the outer circumference 54 are not on the same plane. In an engaged configuration, e.g., when the cap 40 is secured to the container 32, a first portion of the inner circumference 51 and the outer circumference 54 are both located substantially on the same plane. In other words, a portion of the inner circumference 51 and the outer circumference 54 are substantially linear. This is best illustrated in FIG. 2B, where an interior portion of the inner circumference 51 and the outer circumference 54 are substantially aligned and along the same plane of axis. Additionally, in this configuration a second portion of the inner circumference 51 can form a curvature 53 as shown in the figure. This second portion of the inner circumference 51 is between the first or interior portion of the inner circumference 51 and the outer circumference 54.

In operation, when fluid exits or is dispensed from the container 32 as best illustrated in FIG. 2B, a vacuum is created within the container 32. For additional fluid to exit or be dispensed, air needs to return into the container 32. In one embodiment, an aperture 48 can be formed on the exterior surface of the body 42 of the cap 40. The aperture 48 is capable of allowing air or gas to pass into a cavity 57 formed by the curvature 53. The air or gas, is able to pass thereby or around the curvature 53 and the seal 46 and into the container 32 thereby filling the vacuum created and allow additional fluid to be dispensed. The curvature 53, like the body 42, is able to do this because it is formed of an impermeable material, e.g., allows air or gas but not water or liquid to pass through it.

In one embodiment, the outer circumference 54 includes an inner wall 62 and an outer wall 64. This is best illustrated and shown in FIG. 4A. Together the inner wall 62 and the outer wall 64 are able to form a channel 52 therebetween. In the relaxed configuration as best shown in FIG. 2A, the channel 52 between the inner wall 62 and the outer wall 64 is spaced from the interior surface of the body 42 as the cap 40 is not tightly secured to the container 32. In the engaged configuration as best shown in FIG. 2B, the channel 52 between the inner wall 62 and the outer wall 64 is able to abut the interior surface of the body 42 as the cap 40 is tightly secured to the container 32. In other words, in the engaged configuration the channel 52 is configured to receive the rim 56 of the container 32. And because the body 42 of the cap 40 is malleable, the force of rim can deform the annular seal or ring 46 thereby creating a tight enclosure between the annular sealing member 50 and the interior surface of the cap 40.

Figure 3A:
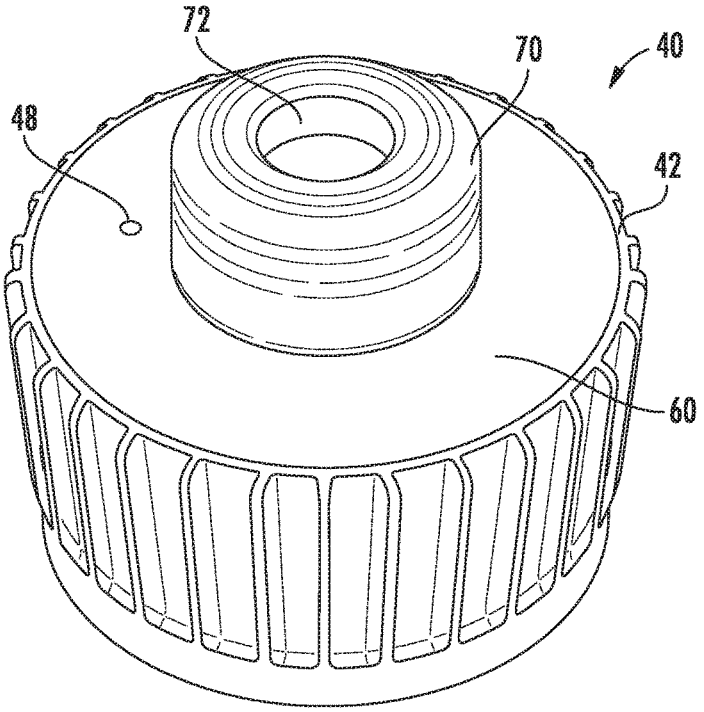
FIGS. 3A-3E are various views of the dispensing enclosure according to one embodiment of the present disclosure.
Figure 3B:
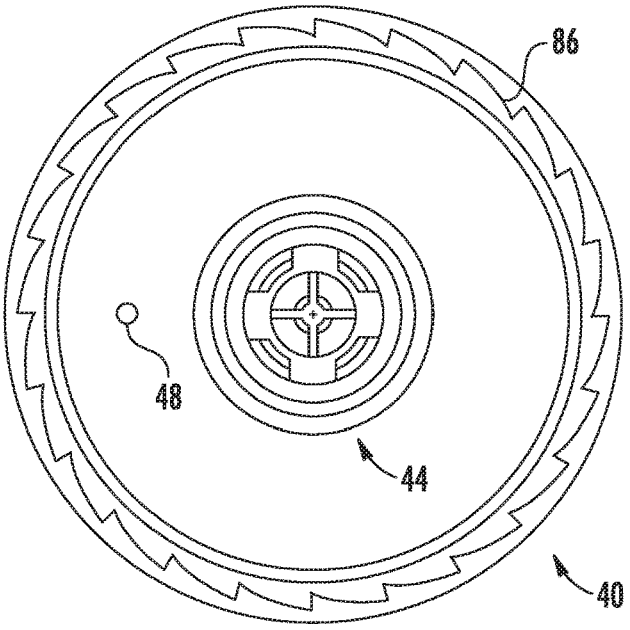
Figure 3C:
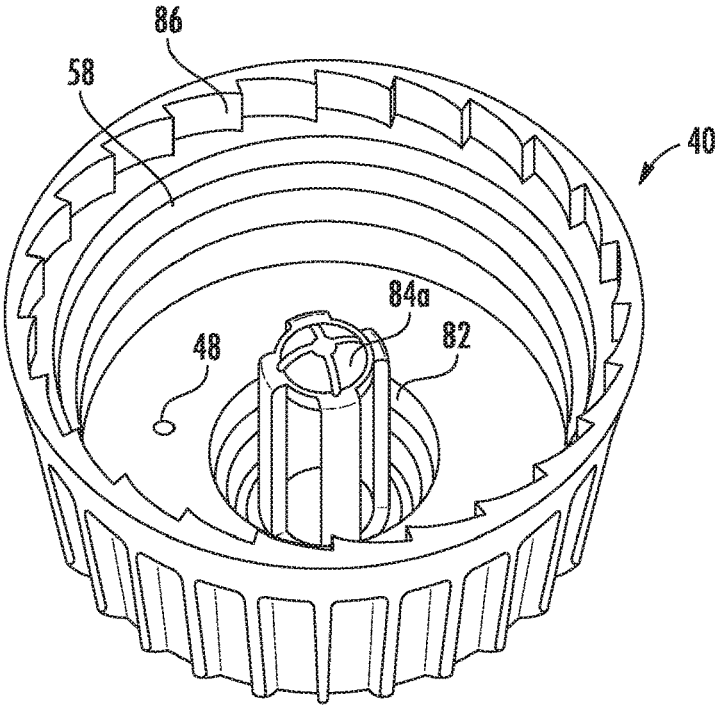
Figure 6C:
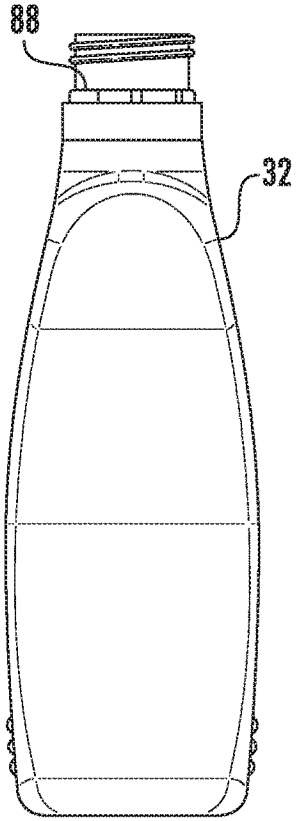
FIGS. 6A-6C are various views of a container according to one embodiment of the present disclosure.
Figure 6B:
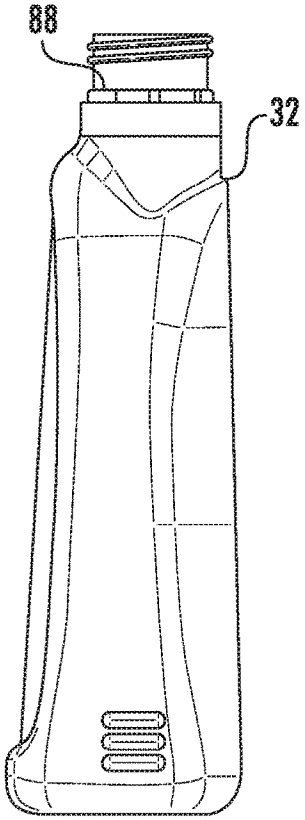
Figure 6A:
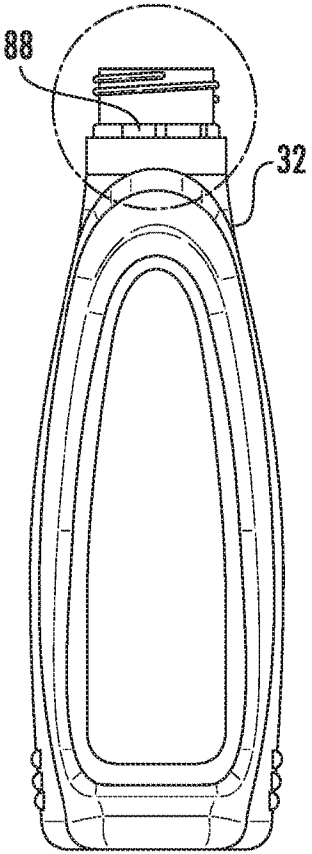

In one embodiment, the outside or exterior surface of the body 42 is generally cylindrical. In some instances, the exterior surface of the body 42 can be annular or ring shaped. In other instances, the exterior surface of the body 42 can be any polygonal shape with a central orifice allowing fluid to exit the container 32 when the cap 40 is mounted thereon. In the example shown, the cylindrical body 42 of the cap 40 can include internal threads 58 on its interior surface for coupling to the container 32, e.g., for coupling to the rim 56 of the container 32. This is best illustrated in FIG. 3C. The threads 58 can correspond to complementary threads about the rim 56 of the container 32, as best illustrated in FIGS. 6A-6C, to securely fasten the cap 40 to the container 32 as can be appreciated and understood by one of ordinary skill in the art. In another embodiment, the cap 40 may also include an external mounting surface 60 about its exterior surface to allow the enclosure system and the reservoir to be mounted into a cleaning appliance such as the appliance 10 shown in FIG. 1.

Figure 4A:
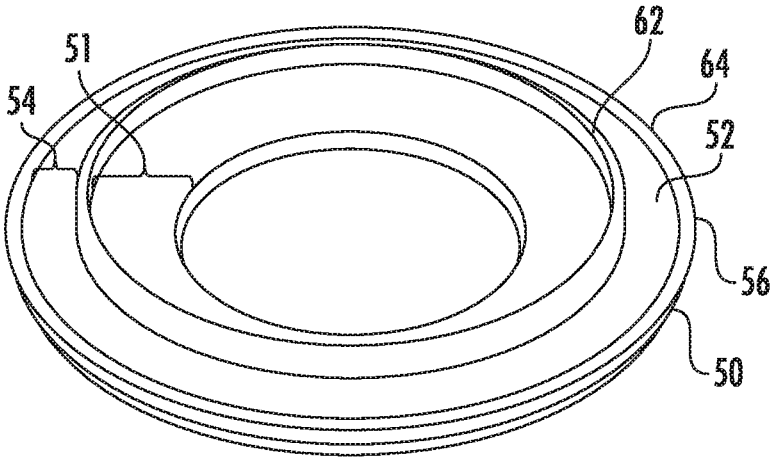
FIGS. 4A-4E are various views of the annular seal for the dispensing enclosure according to one embodiment of the present disclosure.
Figure 4B:
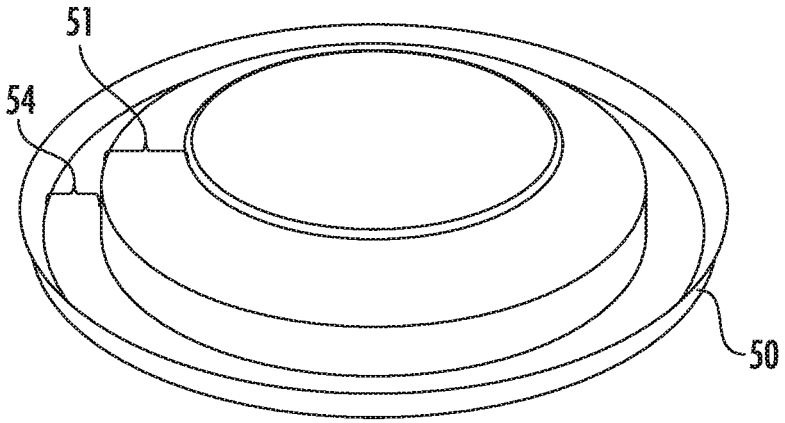
Figure 4C:
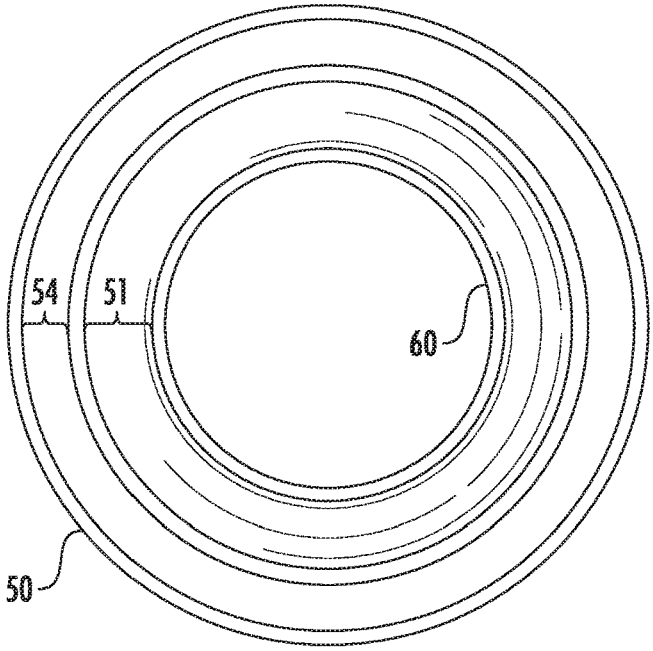
Figure 4D:
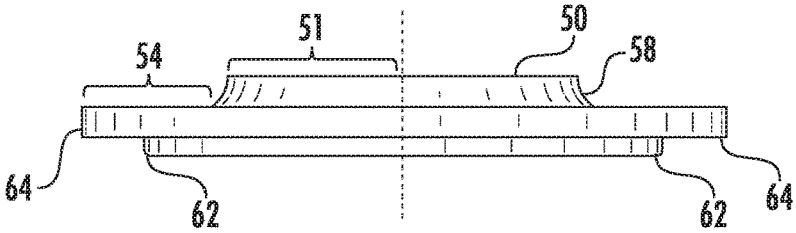
Figure 4E:
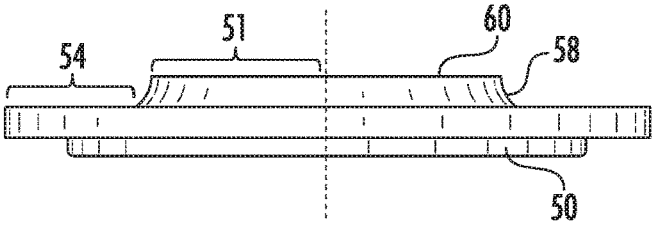
Figure 5A:
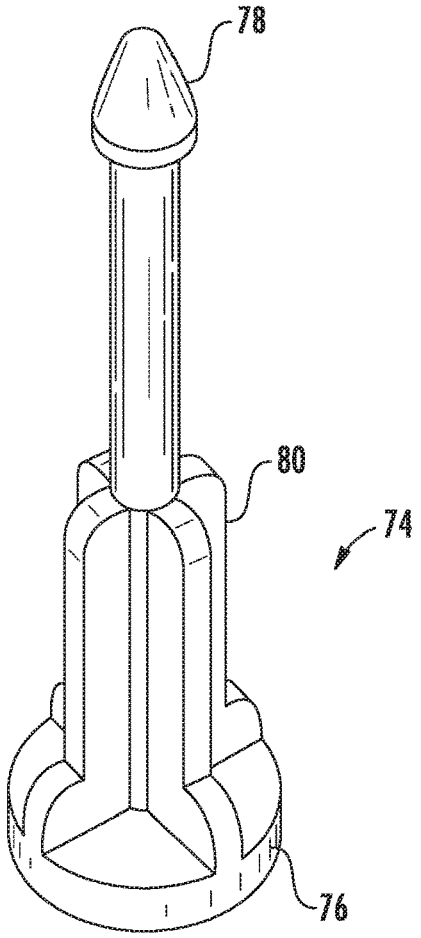
FIGS. 5A-5D are various views of the plunger mechanism for the dispensing enclosure according to one embodiment of the present disclosure.
Figure 5B:
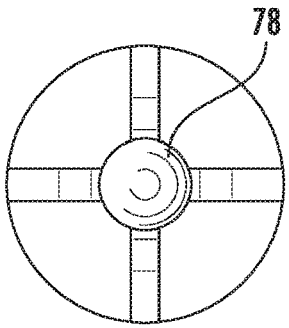
Figure 5C:
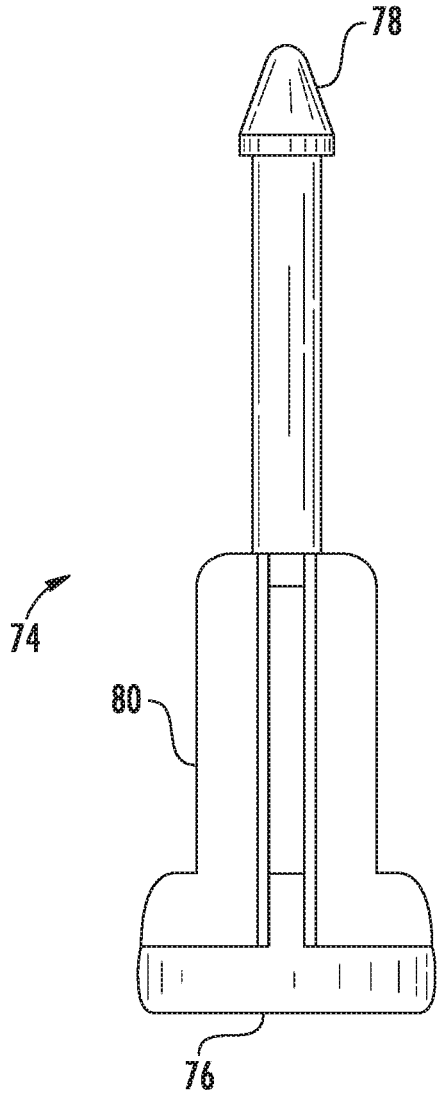
Figure 5D:
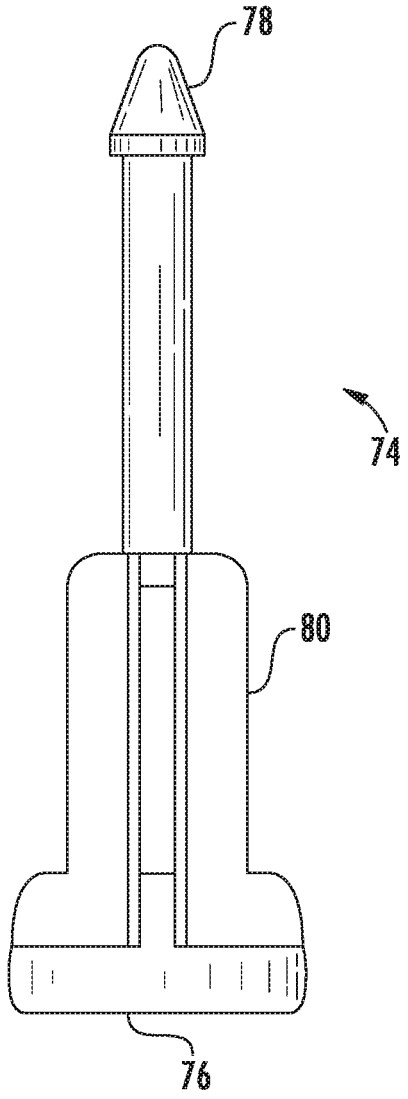

FIGS. 4A-4E are various views of the annular seal or member 50 of the dispensing enclosure according to one embodiment of the present disclosure. As shown in FIGS. 4D and 4E and discussed above, the face of the annular member 50 has a non-linear surface in a relaxed position or unengaged configuration. In another embodiment, the non-linear surface may include a trumpeted surface 58 adjacent an interior border 60 of the annular member 50. The annular resilient member 50 can be mounted inside the cap 40 and may be adjacent to and surrounds the dispensing valve 44. As discussed above, the annular member 50 may include a channel 52 having opposing walls 62, 64 configured to abut inner and outer sides of the rim 556 of the container 32 when the enclosure 40 is screwed onto the container 32. The outer circumference 54 of the annular member 50 can be spaced from the inside surface 65 of the cap in the relaxed position as shown in FIG. 2A, and abuts the inside surface 65 of the cap body 42 at 66 when the enclosure 40 is screwed onto the container 32 as shown in FIG. 2B. When the enclosure 40 is screwed onto the container 32 and the rim 56 is received in the channel 52, the force of the rim 56 is able to deform the annular member 50 thereby creating a closure between the annular member 50 and the interior surface 65 of the cap enclosure 40.

In one embodiment, the annular member 50 may be substantially similar to the sealing member for an enclosure system or cap. The annular member 50 includes a ring-like structure having an inner circumference 51 and an outer circumference 54 as best illustrated in FIGS. 4A-4B.

In a relaxed configuration, each of the inner circumference 51 and the outer circumference 54 is located on a separate plane. This is best illustrated in FIGS. 4D-4E where the circumferences 51, 54 are non-linear and on different axes. In an engaged configuration, a portion of the inner circumference 51 and the outer circumference 54 are located substantially on the same plane as best illustrated in FIG. 2B and discussed above. In addition, a second portion of the inner circumference 51 forms a curvature 53, also best illustrated in FIG. 2B. In this instance, the second portion is in between the first portion and the outer circumference 54.

Like above, the ring 50 can be formed of an impermeable material so as to allow water and gas through it, but not water or other liquid. In addition, the curvature 53 of the ring 50 may be flexible and capable of allowing air to pass thereby refilling the vacuum created with air when liquid is dispensed from the container 32.

In one embodiment, the outer circumference 54 includes an inner wall 62 and an outer wall 64 forming a channel 52 as best illustrated in FIG. 4A. In the engaged configuration, this channel 52 is capable of engaging a rim 56 of the container 32 as best illustrated in FIG. 2B and discussed above.

FIGS. 3A-3E are various views of the dispensing enclosure 40 according to one embodiment of the present disclosure. In one embodiment, the dispensing valve 44 may include an orifice 72 through the center of the valve 44. As shown, the dispensing valve 44 may be mounted within a nipple 70 of the body of the cap 42 and includes an orifice 72 through the body of the cap 42. A plunger 74 may be configured to movably fit within the orifice 72, as best illustrated in FIGS. 2A-2B. In operation, the plunger 74 is configured to be actuated between a closed position (FIG. 2A) and an open position (FIG. 2B). In the closed position, fluid is prevented from exiting out of the container 32 through the orifice 72. In the open position, fluid is able to pass through the orifice 72 and out of the container 32. In one embodiment, a bias element, such as a spring shown in FIGS. 2A-2B, is able to urge or return the plunger 74 from the open position (FIG. 2B) to the closed position (FIG. 2A). In another embodiment, the plunger 74 may include a head 76 and a stop 78 at its opposite end. The plunger 74 may also include wings 80 mounted to the sides of plunger 74 as best illustrated in FIGS. 5A-5D. The wings 80 are configured to retain the bias member, e.g., spring, at its base such that the bias member does not move from side to side. In the closed position, the plunger head 76 is able to seal or enclose the orifice 72 thereby preventing fluid from passing through the orifice 72.

Figure 3D:
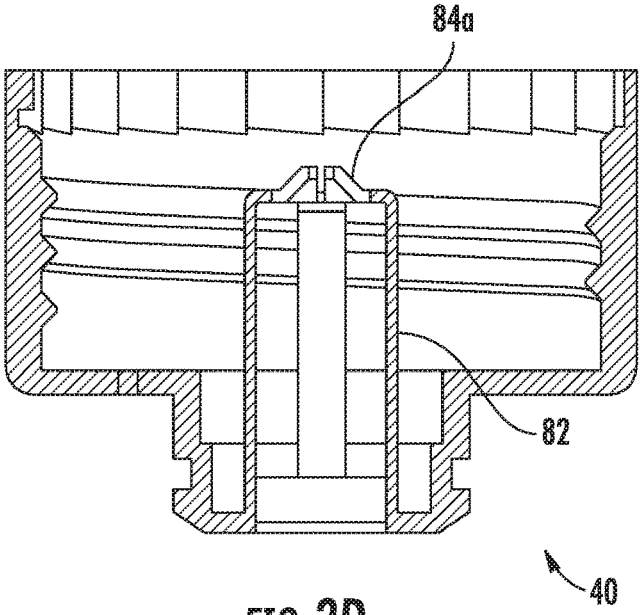
Figure 3E:
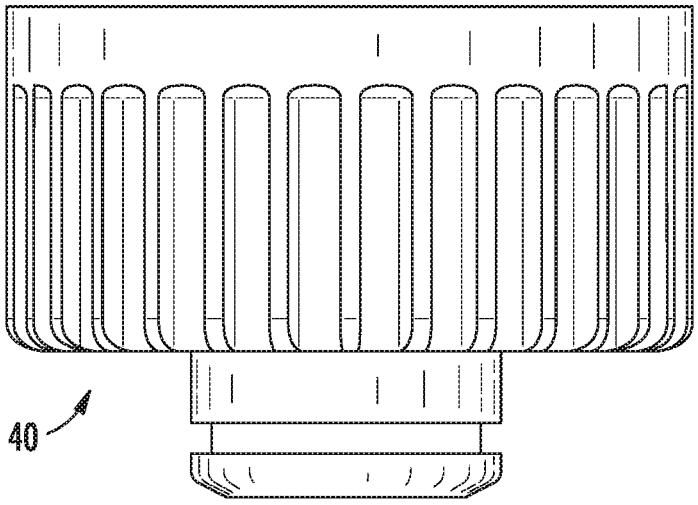

In one embodiment, the dispensing valve 44 further includes a retainer 82 for guiding the plunger 74 through the dispensing valve 44 as best illustrated in FIGS. 2A-2B. In another embodiment, the retainer 82 includes one or more retention members or fingers 84 for engaging the stopper 78 of the plunger 74 so as to retain the plunger 74 in the closed position. In yet another embodiment, the retention members or fingers 84 may be oriented at right angles to the retainer 82 as shown in FIGS. 2A-2B, or may be angled 84*a* with respect to the retainer 82 as shown in FIGS. 3C-3D. Angling of the retention members 84*a* may provide an advantage of easier assembly. To assemble, a bias member, e.g., spring element, would be placed between the plunger 74 and the retainer 82, and the head 76 of the plunger 74 would be passed through the bias member and retention members 84*a* to retain the plunger 74 within the retainer 82.

In some embodiments, the cylindrical portion surrounding the cap 40 further includes ratcheting 86 as shown in FIGS. 3C-3D. The ratcheting 86 can be configured to mate with corresponding detents 88 shown on the rims 56 of the containers 32 as best illustrated in FIGS. 6A-6C to fixedly attach the enclosure 40 to the container 32. In the alternative, ratcheting 86 could be provided on the container 32 and corresponding detents 88 provided in the cap 40. With this feature, a user may be prevented from opening the container 32 once the enclosure 40 is mounted to the container 32. This feature may be useful if it is undesirable or unsafe for an end user to open the container 32 once it has been closed or mounted on the steam appliance 10.

One advantage of embodiments of the container enclosures 40 disclosed herein is that the flow rate of the container 32 and enclosure 40 can be adjusted in a few different manners. For example, the flow rate of the container 32 can be adjusted by selecting the thickness of the inner circumference 51. This will adjust the pressure at which return air will be reintroduced into the container 32. In another embodiment, the flow rate of the container 32 can be adjusted by selecting the number of the holes 48, and/or a size of the holes 48. Since the flow rate depends partly upon the amount of return air reintroduced into the container 32, the flow rate can be adjusted on a container enclosure 40 by simply introducing one or more additional holes 48 or increasing the size of one or more holes 48 in the cap 40.

Another embodiment of the invention includes a method of controlling a flow rate through a container enclosure. The method includes providing one of the container enclosures disclosed herein, and selecting the size and/or number of the at least one hole to determine the amount of return air allowed to pass through the at least one hole when the annular seal is subjected to a partial vacuum within the container, thereby controlling the flow rate of the dispensing enclosure.

In one embodiment, a method of controlling a flow rate through a container enclosure system includes providing a cap for the container, the cap having a body having an exterior surface and an interior surface, where the interior surface of the body is configured to be coupled to the container. Providing a valve on the exterior surface of the body where the valve is operable to allow fluid to exit from the container. In one embodiment, the valve includes an orifice through the center of the valve, a plunger configured to movably fit within the orifice, the plunger capable of moving between a closed position in which the plunger prevents fluid from passing through the orifice and an open position in which the plunger allows the passage of fluid through the orifice. In another embodiment, the valve includes a bias element to urge the plunger to the closed position.

In some embodiments, the enclosure system includes a seal disposed within the interior surface of the body, the seal having an inner circumference and an outer circumference, such that in a relaxed configuration each of the inner circumference and the outer circumference is located on a separate plane, and in an engaged configuration a first portion of the inner circumference and the outer circumference are located substantially on the same plane, and a second portion of the inner circumference forms a curvature, the second portion between the first portion and the outer circumference. In operation, fluid may be dispensed from the container by actuating the plunger.

In another embodiment, the method of controlling a flow rate through a container enclosure includes adjusting the flow of fluid from the container by adjusting the thickness of the inner circumference of the seal. In some instances, the adjusting step further includes forming one or more apertures on the seal, where the seal is formed of an impermeable material.

In another embodiment, the method of controlling a flow rate through a container enclosure includes adjusting the flow of fluid from the container by forming one or more apertures on the exterior surface of the body, the one or more apertures operable to allow air to pass into a cavity defined by the curvature. In some instances, the adjusting step further includes adjusting the size of the one or more apertures on the exterior surface of the body.

Additional advantages of the container enclosures disclosed herein include the use of a small number of parts, which decreases manufacturing costs and complexity.

What has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole While various embodiments in accordance with the disclosed principles have been described above, it should be understood that they have been presented by way of for example only, and are not limiting. Thus, the breadth and scope of the for example embodiments described herein should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

Words of comparison, measurement, and timing such as "at the time," "equivalent," "during," "complete," and the like should be understood to mean "substantially at the time," "substantially equivalent," "substantially during," "substantially complete," etc., where "substantially" means that such comparisons, measurements, and timings are practicable to accomplish the implicitly or expressly stated desired result. Words relating to relative position of elements such as "about," "near," "proximate to," and "adjacent to" shall mean sufficiently close to have a material effect upon the respective system element interactions.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically and by way of for example, although the headings refer to a "Technical Field," such claims should not be limited by the language chosen under this heading to describe the so-called technical field. Further, a description of a technology in the "Background" is not to be construed as an admission that technology is prior art to any invention(s) in this disclosure. Neither is the "Summary" to be considered as a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings herein.

What is claimed is:

1. A seal comprising:

a ring having an inner horizontal circumferential region and an outer horizontal circumferential region, the outer horizontal circumferential region having an inner vertical wall and an outer vertical wall extending therefrom forming a horizontal channel therebetween;

wherein in a relaxed configuration, each of the inner horizontal circumferential region and the outer horizontal circumferential region is located on a separate horizontal plane; and wherein in an engaged configuration, a first portion of the inner horizontal circumferential region and the outer horizontal circumferential region are located substantially on the same horizontal plane and a second portion of the inner horizontal circumferential region forms a curvature, the second portion between the first portion and the outer horizontal circumferential region.

2. The seal of claim 1, wherein the ring is formed of a liquid impermeable material.

3. The seal of claim 2, wherein the curvature is flexible and operable to allow air to pass thereby.

4. The seal of claim 3, further comprising a cavity defined by the curvature.

5. The seal of claim 1, wherein the horizontal channel is configured to engage a rim of a container in the engaged configuration.

6. A cap for a container, the cap comprising:

a body having an exterior surface and an interior surface, the interior surface configured to be coupled to the container;

a valve on the exterior surface, the valve operable to allow fluid to exit from the container; and a seal disposed within the interior surface, the seal comprising a ring having an inner horizontal circumferential region and an outer horizontal circumferential region, the outer horizontal circumferential region having an inner vertical wall and an outer vertical wall extending therefrom forming a horizontal channel therebetween;

wherein in a relaxed configuration, each of the inner horizontal circumferential region and the outer horizontal circumferential region is located on a separate horizontal plane; and wherein in an engaged configuration, a first portion of the inner circumferential region and the outer horizontal circumferential region are located substantially on the same horizontal plane, and a second portion of the inner horizontal circumferential region forms a curvature, the second portion between the first portion and the outer horizontal circumferential region.

7. The cap of claim 6, wherein the seal is formed of a liquid impermeable material.

8. The cap of claim 6, further comprising an aperture on the exterior surface.

9. The cap of claim 8, wherein the aperture is operable to allow air to pass into a cavity defined by the curvature.

10. The cap of claim 9, wherein in the relaxed configuration the horizontal channel is spaced from the interior surface and wherein in the engaged configuration the horizontal channel abuts the interior surface.

11. The cap of claim 9, wherein in the engaged configuration the horizontal channel is configured to receive the rim of the container.

12. The cap of claim 6, wherein the valve further includes:

an orifice through the center of the valve;

a plunger configured to movably fit within the orifice, the plunger operable to move between a closed position in which the plunger prevents fluid from passing through the orifice and an open position in which the plunger allows the passage of fluid through the orifice; and a bias element urging the plunger to the closed position.

13. The cap of claim 12, wherein the valve further includes a retainer for guiding the plunger through the valve, the retainer includes fingers for retaining the plunger in the closed position.

14. The cap of claim 6, wherein the body is substantially cylindrical and the interior surface includes threads for coupling to the rim of the container.

15. The cap of claim 14, wherein one of the body and the container includes ratcheting and the other includes detents, the ratcheting and the detents configured to mate with each other to fixedly attach the cap to the container.

16. A method comprising:

providing a cap for a container, the cap having:

a body having an exterior surface and an interior surface, the interior surface of the body configured to be coupled to the container;

a valve on the exterior surface of the body, the valve operable to allow fluid to exit from the container, the valve including:

an orifice through the center of the valve;

a plunger configured to movably fit within the orifice, the plunger operable to move between a closed position in which the plunger prevents fluid from passing through the orifice and an open position in which the plunger allows the passage of fluid through the orifice; and a bias element urging the plunger to the closed position;

a seal disposed within the interior surface of the body, the seal comprising a ring having an inner horizontal circumferential region and an outer horizontal circumferential region, the outer horizontal circumferential region having an inner vertical wall and an outer vertical wall extending therefrom forming a horizontal channel therebetween;

wherein in a relaxed configuration, each of the inner horizontal circumferential region and the outer horizontal circumferential region is located on a separate horizontal plane; and wherein in an engaged configuration, a first portion of the inner horizontal circumferential region and the outer horizontal circumferential region are located substantially on the same horizontal plane, and a second portion of the inner horizontal circumferential region forms a curvature, the second portion between the first portion and the outer horizontal circumferential region; and dispensing fluid from the container by actuating the plunger.

17. The method of claim 16, further comprising:

adjusting the flow of fluid from the container by adjusting the thickness of the inner horizontal circumferential region of the seal.

18. The method of claim 17, wherein the adjusting step further includes forming one or more apertures on the seal, and wherein the seal is formed of a liquid impermeable material.

19. The method of claim 16, further comprising:

adjusting the flow of fluid from the container by forming one or more apertures on the exterior surface of the body, the one or more apertures operable to allow air to pass into a cavity defined by the curvature.

20. The method of claim 19, wherein the adjusting step further includes adjusting the size of the one or more apertures on the exterior surface of the body.

* * * * *